US006581723B2

(12) United States Patent
Brandt et al.

(10) Patent No.: US 6,581,723 B2
(45) Date of Patent: Jun. 24, 2003

(54) MUFFLER SHELL FILLING PROCESS, MUFFLER FILLED WITH FIBROUS MATERIAL AND VACUUM FILLING DEVICE

(75) Inventors: Luc J. L. Brandt, Henri-Chapelle (BE); Leon Charlier, Henri-Chapelle (BE)

(73) Assignee: Owens Corning Composites SPRL, Brussels (BE)

( * ) Notice: Subject to any disclaimer, the term of this patent is extended or adjusted under 35 U.S.C. 154(b) by 0 days.

(21) Appl. No.: 09/945,074

(22) Filed: Aug. 31, 2001

(65) Prior Publication Data

US 2003/0042070 A1 Mar. 6, 2003

(51) Int. Cl.[7] ..... F01N 1/24

(52) U.S. Cl. ..... 181/256; 181/222; 181/252; 29/890.08

(58) Field of Search ..... 181/256, 252, 181/222, 282, 272; 29/890.08, 463

(56) References Cited

U.S. PATENT DOCUMENTS

| | | | | |
|---|---|---|---|---|
| 3,921,273 | A | 11/1975 | Kondo et al. | |
| 4,569,471 | A | 2/1986 | Ingemansson et al. | |
| RE32,258 | E | 10/1986 | Kondo et al. | |
| 4,774,985 | A | 10/1988 | Broadbelt et al. | |
| 5,036,585 | A | 8/1991 | Schweinfurth | |
| 5,365,025 | A * | 11/1994 | Kraai et al. | 181/252 |
| 5,398,407 | A | 3/1995 | Stuer | |
| 5,461,777 | A | 10/1995 | Ikeda et al. | |
| 5,479,706 | A | 1/1996 | Tamano et al. | |

FOREIGN PATENT DOCUMENTS

| | | | | |
|---|---|---|---|---|
| EP | 0106481 A2 * | 4/1984 | ..... | F01N/7/18 |
| EP | 0692616 A1 | 1/1996 | | |

OTHER PUBLICATIONS

Lewin, US Pending 09/811,222, (Mar. 16, 2001).

*Primary Examiner*—Robert E. Nappi
*Assistant Examiner*—Edgardo San Martin
(74) *Attorney, Agent, or Firm*—Inger H. Eckert; James J. Dottavio (List continued on next page.)

(57) ABSTRACT

A process is provided for filling a muffler shell with fibrous material. The process involves providing a muffler shell comprising first and second muffler shell outer parts which define an internal cavity when coupled together and an internal structure adapted to extend at least part way through the shell internal cavity and having one or more openings communicating with the shell internal cavity. The process further comprises the steps of: providing a perforated tool having opposing first and second surfaces; providing a vacuum apparatus which is adapted to receive the perforated tool and apply a partial vacuum to the first surface of the tool; placing a sheet adjacent the second surface of the perforated tool; applying a partial vacuum to the first surface of the tool via the vacuum apparatus so as to draw the sheet against the tool second surface; placing the internal structure adjacent the tool; placing the first muffler shell outer part adjacent the tool such that the tool and the first part define a temporary inner cavity; feeding fibrous material into the temporary inner cavity; deactivating the vacuum apparatus; drawing a partial vacuum through the internal structure so as to draw the fibrous material and the sheet toward the internal structure; separating the first muffler shell outer part, the internal structure, the fibrous material and the sheet from the tool; and coupling the second muffler shell part to the first muffler shell part.

22 Claims, 6 Drawing Sheets

U.S. PATENT DOCUMENTS 5,766,541 A 6/1998 Knutsson et al.
5,783,782 A * 7/1998 Sterrett et al. ..... 181/272
5,784,784 A 7/1998 Flanigan et al.
5,859,394 A 1/1999 Seehaus et al.
5,907,904 A 6/1999 Gerber et al.
5,976,453 A 11/1999 Nilsson et al.
6,053,276 A 4/2000 D'Amico, Jr. et al.
6,068,082 A 5/2000 D'Amico, Jr. et al.
6,089,348 A * 7/2000 Bokor ..... 181/256
6,094,817 A 8/2000 Shah et al.
6,148,519 A 11/2000 Stenersen et al.
6,158,547 A 12/2000 Ackermann et al.
6,241,043 B1 6/2001 Goertz
6,317,959 B1 * 11/2001 Nilsson et al. ..... 298/890.08
6,370,747 B1 * 4/2002 Lewin et al. ..... 28/289
6,412,596 B1 * 7/2002 Brandt et al. ..... 181/256
6,446,750 B1 * 9/2002 Lewin ..... 181/256
2001/0011780 A1 * 8/2001 Knutsson ..... 181/252

* cited by examiner

MUFFLER SHELL FILLING PROCESS, MUFFLER FILLED WITH FIBROUS MATERIAL AND VACUUM FILLING DEVICE

TECHNICAL FIELD AND INDUSTRIAL APPLICABILITY OF THE INVENTION

This invention relates to a process for filling a muffler shell with fibrous material, a muffler shell filled with fibrous material and a vacuum-filling device adapted for use during a muffler shell filling operation.

BACKGROUND OF THE INVENTION

U.S. Pat. No. 4,569,471 to Ingemansson et al. describes a process and apparatus for feeding lengths of a continuous glass fiber strand into a muffler outer shell. The apparatus includes a nozzle for expanding the fiber strand into a wool-like material before the material centers the outer shell. In a first embodiment, filling of an outer cylinder 14 of the muffler shell occurs without an end-piece joined to the outer cylinder 14. After the filling operation is completed, the outer cylinder 14 is moved to a separate station where the end piece is welded onto the outer cylinder 14. In a second embodiment, illustrated in FIG. 3, a perforated pipe/outer end piece assembly is located only part way in the muffler outer cylinder 14 during the glass material filling operation. After the filling operation has been completed, the perforated pipe/end piece assembly is moved to its final position within the outer cylinder 14.

The '471 patent process is acceptable when filling a muffler shell of the type including a separate end piece or perforated pipe/outer end piece assembly. However, the process is typically not used with clam shell mufflers comprising first and second halves which, when coupled together and enclosing a perforated pipe, do not have an open end through which fibrous material may be fed.

It is also known in the prior art to form preforms from glass material which are adapted to be inserted into a first muffler shell section prior to it being coupled to a corresponding second shell section; see U.S. Pat. No. 5,766,541, the disclosure of which is incorporated herein by reference. While such preforms are acceptable in performance, they add additional cost to the muffler due to the manufacturing steps necessary to form the preforms.

It is also known to fill bags or a mesh with fibrous material. The filled bag or mesh is then inserted into a first muffler shell section prior to the first shell section being coupled to a second shell section, see U.S. Pat. No. 6,068,082, the disclosure of which is incorporated herein by reference.

Hence, there is a need for an improved, low-cost muffler outer shell filling process which can be used to fill muffler shells such as clam-type muffler shells.

SUMMARY OF THE INVENTION

This need is met by the present invention, wherein a process is provided for filling a clam-type muffler shell using a vacuum-filling device. The device comprises a perforated tool and a vacuum apparatus adapted to receive the tool and apply a partial vacuum to a first surface of the tool. A sheet covers most, but preferably not all, openings provided in the perforated tool. The vacuum functions to maintain the sheet positioned adjacent to the tool. An internal structure, comprising one or more perforated elements such as one or more perforated pipes, is placed on the sheet and tool. A first muffler shell outer part is positioned adjacent to the tool such that a temporary inner cavity is defined by the tool and the first outer part. The inner cavity is then filled with fibrous material. Subsequent to the filling operation, the partial vacuum applied to the tool is removed. After the vacuum is removed from the tool, a partial vacuum is applied to the internal structure. The vacuum causes the fibrous material and the sheet to be drawn inwardly towards the internal structure. The first outer part, internal structure, fibrous material and sheet are then removed from the tool. If any portion of the sheet or fibrous material extends outwardly beyond the outer edge of the first part, the sheet and/or fibrous material is repositioned or moved inwardly so that it no longer extends beyond the outer edge. A second muffler shell outer part is then placed on the first part. The partial vacuum applied to the internal structure may be removed at this juncture. The first and second muffler shell parts are then coupled together such as by welding, flange crimping or fasteners. It is noted that any fibrous material extending out beyond the outer edges of the first and second muffler shell outer parts may have a detrimental impact on the weld at that point, i.e., may cause a void in the weld, and exposed fibers are aesthetically undesirable.

In accordance with a first aspect of the present invention, a process is provided for filling a muffler shell with fibrous material. The process involves providing a muffler shell comprising first and second muffler shell outer parts which define an internal cavity when coupled together and an internal structure adapted to extend at least part way through the shell internal cavity and having one or more openings communicating with the shell internal cavity. The process further comprises the steps of: providing a perforated tool having opposing first and second surfaces; providing a vacuum apparatus which is adapted to receive the perforated tool and apply a partial vacuum to the first surface of the tool; placing a sheet adjacent the second surface of the perforated tool; applying a partial vacuum to the first surface of the tool via the vacuum apparatus so as to draw the sheet against the tool second surface; placing the internal structure adjacent the tool; placing the first muffler shell outer part adjacent the tool such that the tool and the first part define a temporary inner cavity; feeding fibrous material into the temporary inner cavity; deactivating the vacuum apparatus; drawing a partial vacuum through the internal structure so as to draw the fibrous material and the sheet toward the internal structure; separating the first muffler shell outer part, the internal structure, the fibrous material and the sheet from the tool; and coupling the second muffler shell part to the first muffler shell part.

The fibrous material feeding step may comprise the steps of: providing a texturizing device having a nozzle; feeding continuous strand material and pressurized air into the texturizing device such that a wool-type product emerges from the nozzle; and positioning the nozzle adjacent to or in the temporary internal cavity such that the wool-type product is fed into the temporary internal cavity.

The vacuum apparatus may comprise a structure having an inner cavity communicating with a first vacuum source. The structure may further include an edge portion defining an opening to the inner cavity. The edge portion is adapted to receive the tool.

Preferably, the vacuum apparatus is deactivated after the fibrous material feeding step.

The step of drawing a partial vacuum through the internal structure may comprise the step of connecting the first vacuum source to the internal structure. Alternatively, the step of drawing a partial vacuum through the internal structure may comprise the step of coupling a second vacuum source to the internal structure.

The perforated tool preferably has a plurality of openings formed in it. The step of placing a sheet adjacent the second surface of the perforated tool may comprise the step of placing the sheet over the second tool surface such that the sheet covers at least a portion of the openings in the tool. If the sheet has either no perforations or only very small and/or a limited number of perforations, it is preferred that the sheet cover only a first portion of the openings in the tool such that a second portion of the openings is left uncovered. The second portion of openings allow a partial vacuum to be drawn within the temporary inner cavity such that the fibrous material is drawn inwardly into the cavity and compacted therein.

The step of placing the internal structure adjacent to the tool comprises the step of placing the internal structure in the tool over the sheet.

The step of coupling the second muffler shell part to the first muffler shell part may comprise the steps of: placing the second muffler shell part adjacent the first muffler shell part such that the first and second muffler shell parts define an internal cavity containing the internal structure, the fibrous material and the sheet; and joining the first and second muffler shell parts to one another.

The process preferably comprises the additional step of discontinuing the step of drawing a partial vacuum through the internal structure after the step of placing the second muffler shell part adjacent the first muffler shell part.

The internal structure may comprise at least one perforated element such as one or more perforated pipes.

The internal structure may also comprise at least one partition defining at least two internal compartments within the muffler shell internal cavity. The at least one internal compartment may be left unfilled with fibrous material.

In accordance with a second aspect of the present invention, a muffler filled with fibrous material and a sheet in accordance with the process set out above is provided.

In accordance with a third aspect of the present invention, a muffler is provided comprising a muffler shell including first and second muffler shell outer parts which define an internal cavity. The second muffler shell outer part includes a first external surface and a second internal surface. An internal structure is adapted to extend at least part way through the shell internal cavity and has one or more openings communicating with the shell internal cavity. Fibrous material is filled in the internal cavity. A sheet extends only between the second internal surface of the second muffler shell part and the fibrous material, i.e., the sheet engages the second internal surface of the second muffler shell part but does not engage a substantial portion of an internal surface of the first muffler shell part. The sheet does not comprise a bag filled with and containing fibrous material. The sheet may or may not be perforated.

The fibrous material comprises a mineral fiber wool-type product.

The internal structure may comprise at least one partition defining at least two internal compartments within the muffler shell internal cavity. At least one of the internal compartments may be completely devoid of fibrous material.

In accordance with a fourth aspect of the present invention, a vacuum-filling device is provided which is adapted to be used during a muffler shell filling operation. The muffler shell comprises first and second muffler shell outer parts which define an internal cavity when coupled together. An internal structure is adapted to be positioned within the muffler shell internal cavity. The device comprises: a perforated tool having first and second surfaces; and a vacuum apparatus adapted to receive the perforated tool and apply a partial vacuum to the first surface of the tool.

The vacuum apparatus comprises a structure with an inner cavity that communicates with a first vacuum source. The structure further includes an edge portion defining an opening to the inner cavity. The edge portion is adapted to receive the tool.

The tool has generally the same shape as the second muffler shell outer part. Further, the tool has at least one opening for receiving a nozzle of a texturizing device.

DETAILED DESCRIPTION AND PREFERRED EMBODIMENTS OF THE INVENTION

A process is provided for filling mufflers with fibrous material. Mufflers filled in accordance with the present invention are capable of being incorporated into vehicle exhaust systems and function as acoustic attenuators.

Figure 1:
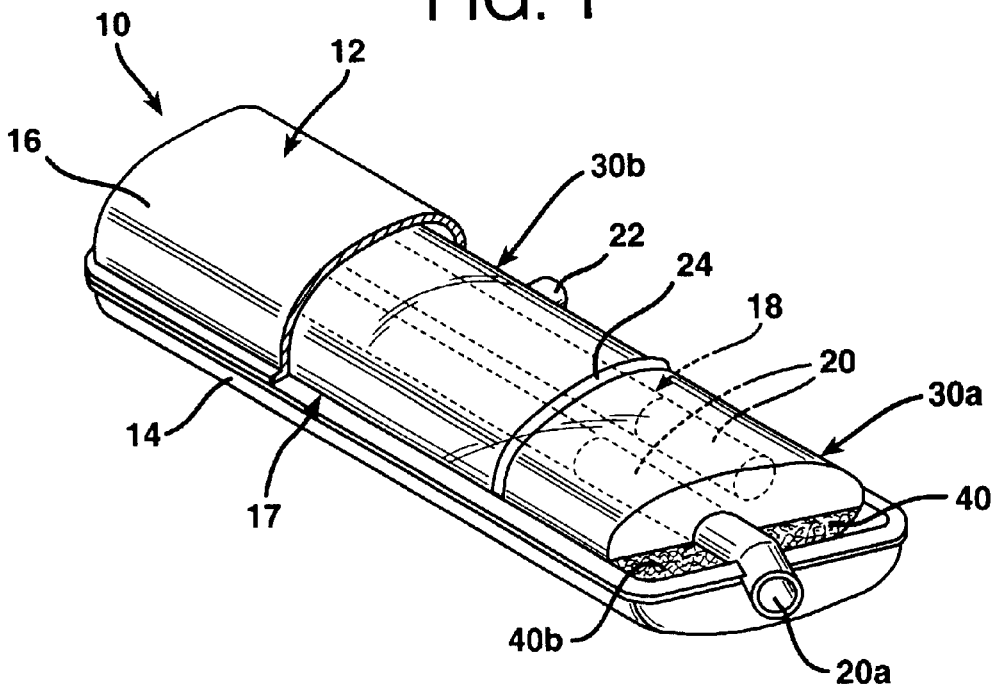
FIG. 1 is a view, partially broken away, of a clam shell muffler filled with fibrous material in accordance with the present invention.

FIG. 1 illustrates a muffler 10 filled with fibrous material in accordance with the present invention. The muffler 10 comprises an outer shell 12 formed from first and second muffler shell outer parts 14 and 16. The first and second parts 14 and 16 define an internal cavity 17 when coupled together. An internal structure 18 is provided in the shell internal cavity 17. In the illustrated embodiment, the structure 18 comprises a generally U-shaped perforated pipe 20, an inlet pipe 22 coupled to the perforated pipe 20 so as to communicate with the pipe 20, and first and second partitions 24 and 26, see FIGS. 1, 5 and 8. The partitions 24 and 26 define first, second and third compartments 30*a*–30*c* within the muffler 10 and may be perforated so as to permit gases to pass between the compartments 30*a*–30*c*. As will be discussed further below, the shell internal cavity 17 is filled with fibrous material 40 which defines a wool-type product 40b within the internal cavity 17, see FIGS. 1 and 8.

A first exhaust pipe (not shown) extending between a vehicle engine and the muffler 10 is coupled to the inlet pipe 22. A second exhaust pipe (not shown) is coupled to an exit portion 20*a* of the perforated pipe 20. During operation of a vehicle to which the muffler 10 is attached, exhaust gases pass into the muffler via the first exhaust pipe. Acoustic energy generated by those gases passes through and from the perforated pipe 20 to the wool-type product 40*b* which functions to dissipate a portion of that acoustic energy.

The first and second muffler shell outer parts 14 and 16 may be of any conventional and suitable shape. Further, the internal structure 18 may comprise one or more perforated pipes; one or more non-perforated pipes coupled to one or more perforated pipes; or one or more perforated elements, such as a triangular, rectangular or other geometric shaped element coupled to one or more perforated or non-perforated pipes. It is also contemplated that the internal structure 18 may include 0, 1 or 3 or more partitions.

Figure 2:
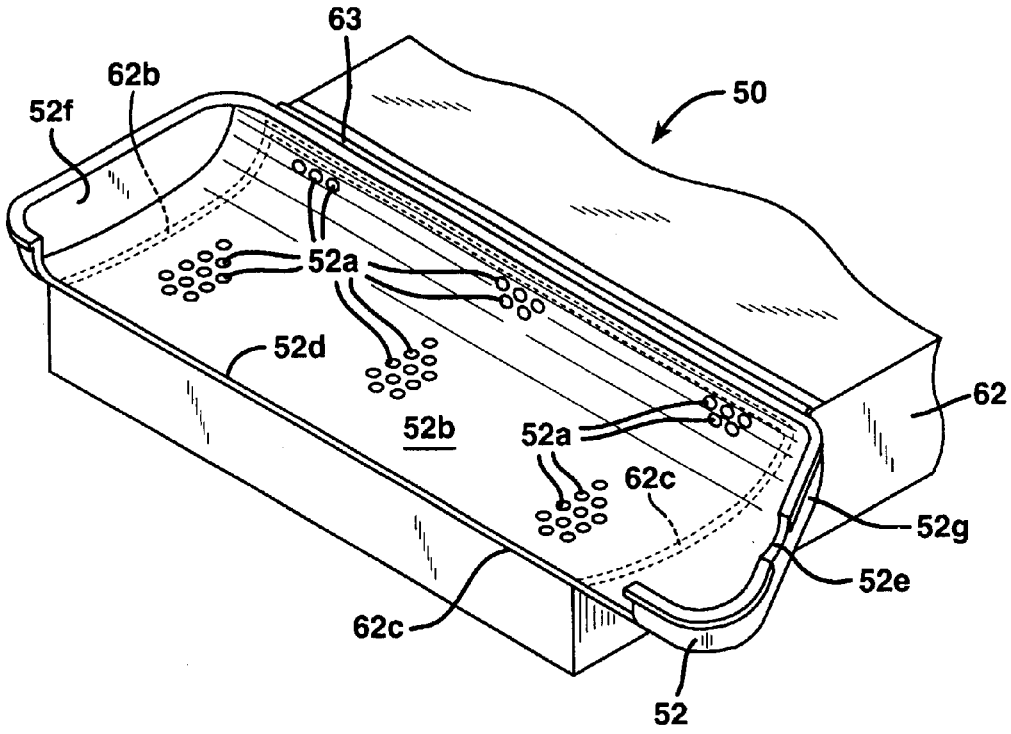
FIG. 2 is a view of a portion of a vacuum-filling device constructed in accordance with the present invention.
Figure 2A:
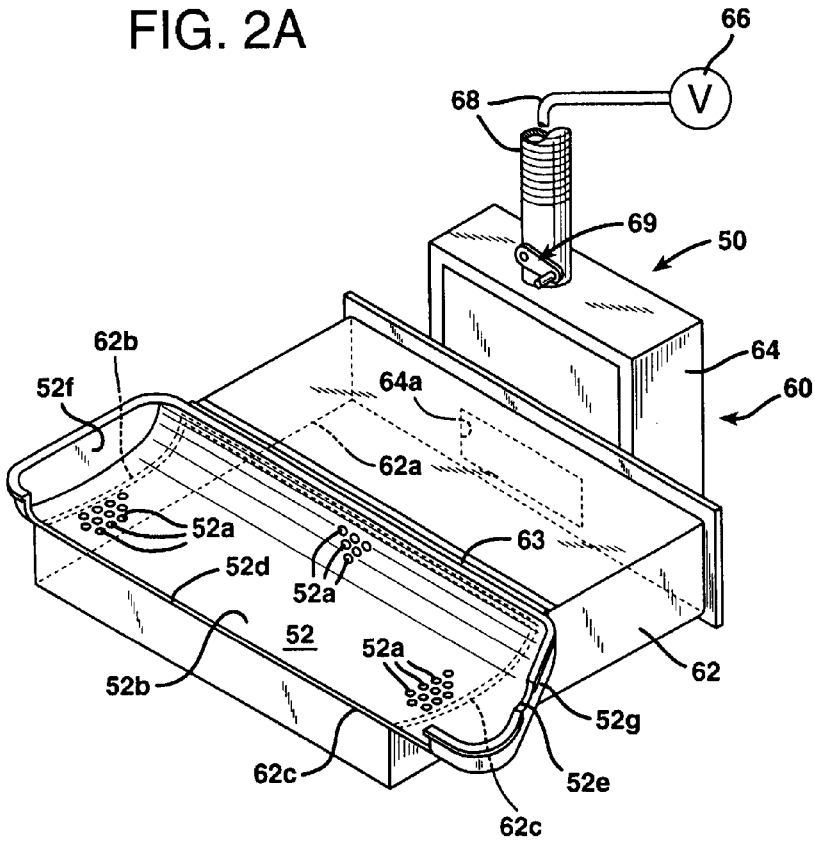
FIG. 2A is a view of the vacuum-filling device of the present invention.

A vacuum-filling device 50, such as the one illustrated in FIGS. 2 and 2A, may be used during the muffler shell filling operation. The filling device 50 comprises a perforated tool 52 having generally the same shape as the second muffler shell outer part 16. A plurality of openings 52*a* are provided in the tool 52 and preferably have a diameter of from about 3.0 millimeters to about 20.0 millimeters. The device 50 further comprises a vacuum apparatus 60 having first and second box-like structures 62 and 64 coupled to one another. Inner cavities 62*a* and 64*a* formed in the first and second structures 62 and 64 communicate with one another. Further provided is a first vacuum source 66 which communicates with the inner cavities 62*a* and 64*a* via a hose 68. Vacuum from the vacuum source 66 may be closed off via vacuum shut-off valve 69, illustrated in FIG. 2A.

The first structure 62 is provided with an opening 62*b* to its inner cavity 62*a*. The perimeter of the opening 62*b* is defined by an edge 62*c* on the first structure 62. In the illustrated embodiment, the tool 52 is pivotably coupled to the first structure 62 via hinge 63. It sits on the edge 62*c* over the opening 62*b*. Hence, a partial vacuum created in the inner cavity 62*a* results in a partial vacuum being drawn through the openings 52*a* in the tool 52. It is contemplated that the edge 62*c* may be provided with a polymeric seal so as to reduce the likelihood that air or gases will pass through the edge 62*c* and tool 52 interface during activation of the vacuum source 66.

Figure 3:
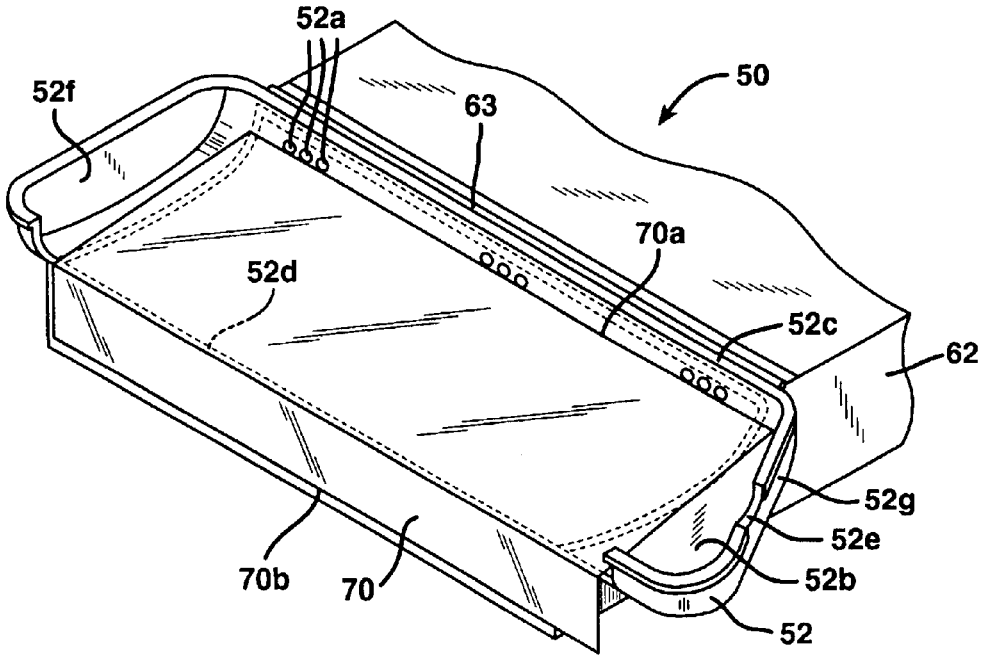
FIG. 3 is a view of the vacuum filling device with a sheet placed over a second surface of a tool of the device.
Figure 4:
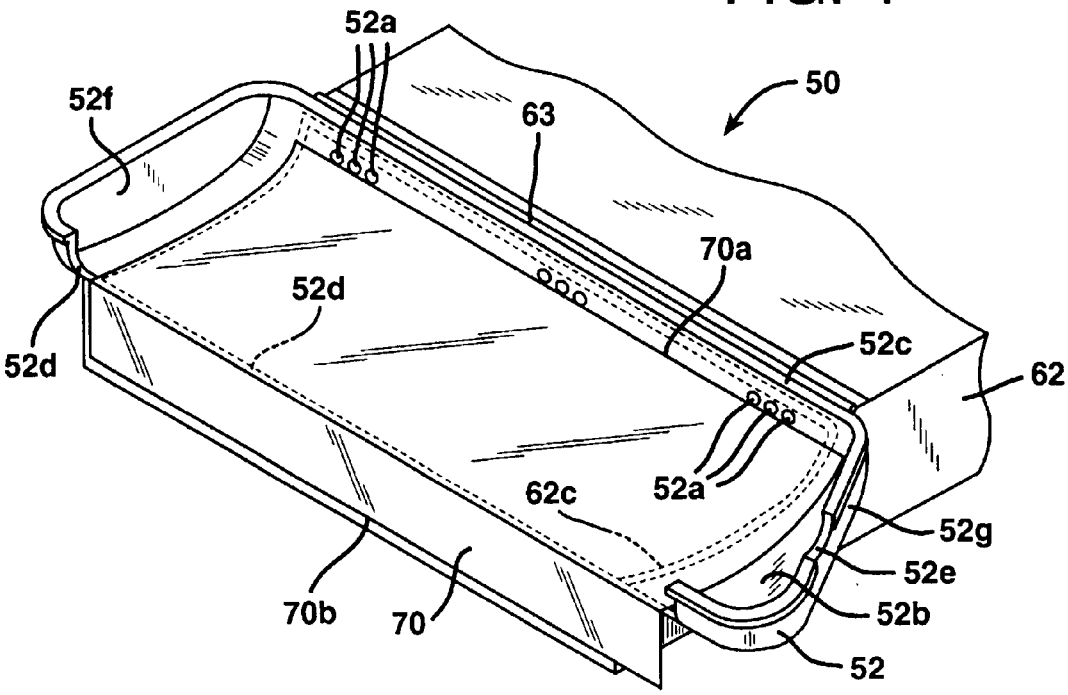
FIG. 4 is a view illustrating the sheet drawn inwardly into the tool after activation of a vacuum source.

An initial step in the process for filling a muffler shell 12 with fibrous material 40 involves placing a sheet 70 over an upper surface 52*b* of the tool 52, see FIG. 3. In the illustrated embodiment, the sheet 70 comprises a polymeric film. However, the sheet may also be formed from paper, cardboard or any other suitable material. The sheet 70 may also comprise a fiberglass, paper, polymeric or metal mesh. With the vacuum source 66 activated, the valve 69 is then opened such that the sheet 70 is drawn downwardly against the tool upper surface 52*b*, see FIG. 4. Alternatively, the vacuum source 66 may be activated and the valve 69 positioned in its open state prior to the sheet 70 being placed on the tool surface 52*b*. In a first embodiment, the sheet is either not perforated or includes only a very limited area having perforations, such as no more than 10% of the total area of the sheet 70. So as to assist in compacting the fibrous material 40 during a subsequent fibrous material filling operation, to be discussed below, a first edge 70*a* of the sheet 70 is spaced from about 10.0 millimeters to about 150.0 millimeters from a back edge 52*c* of the tool 52. By leaving a gap between the sheet edge 70*a* and the tool back edge 52*c*, a number of the openings 52*a* in the tool 52 are left uncovered. These uncovered openings 52*a* allow a partial vacuum to be generated in a temporary inner cavity, to be discussed below, such that the fibrous material 40 added to the temporary inner cavity during a filling operation is drawn inwardly into the temporary inner cavity and compacted. As is apparent from FIGS. 3 and 4, the sheet 70 extends through a slot 52*d* in the tool 52 such that a second edge 70*b* of the sheet 70 is positioned outside the tool 52. It is also contemplated that the first edge 70*a* of the sheet 70 having either no perforations or only a limited area with perforations may be spaced from about 0.0 mm to about 10.0 mm from the tool back edge 52*c*.

In accordance with a second embodiment of the present invention, a sheet (not shown) is provided with a sufficient number of adequately sized perforations or openings, the number and size of which will be apparent to one skilled in the art, such that the first edge of the sheet may be positioned adjacent to or engage the back edge 52*c* of the tool 52. In this embodiment, the perforations provide sufficient pathways through which air may be drawn during the fibrous material feeding operation to allow the fibrous material 40 to be adequately drawn into the temporary inner cavity and compacted therein.

Figure 5:
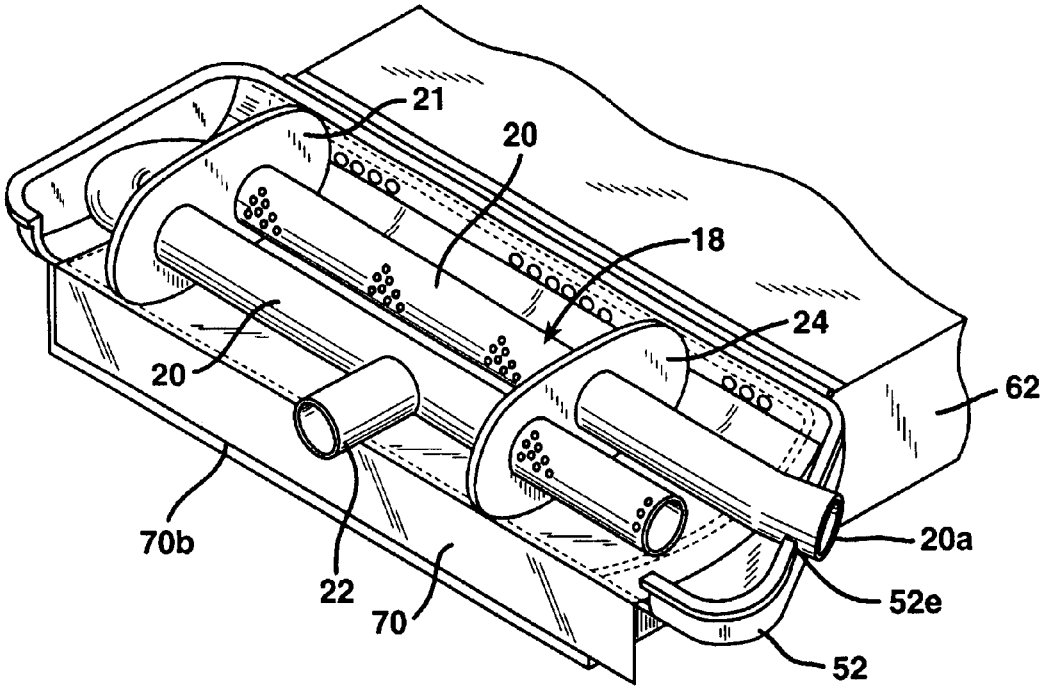
FIG. 5 is view showing the muffler internal structure positioned in the tool.

Once the sheet 70 has been drawn toward the tool upper surface 52*b*, the internal structure 18 is placed in the tool 52 over the sheet 70, see FIG. 5. The exit portion 20*a* of the U-shaped pipe 20 is received in a recess 52*e* provided in the tool 52. Next, the first muffler shell outer part 14 is positioned in engagement with the tool 52. The shell outer part 14 and the tool 52 define a temporary inner cavity 170. Conventional elastic bands, fasteners, adhesive or the like may be used if necessary to maintain the part 14 and tool 52 coupled together.

The next step in the process involves filling the temporary inner cavity 170 with the fibrous material 40. Before this step occurs, the vacuum source 66 is activated and the valve 69 is positioned in its open state. Further, a plug 60 is preferably placed in the inlet pipe 22 so as to prevent air and fibers from being drawn through the pipe 22 during the fibrous filling operation and, at a later stage in the filling process, which will be discussed below, to maximize the amount of air that is drawn through the openings or perforations in the internal structure 18, thereby increasing the compaction of the sheet 70 and the fibrous material 40 against the internal structure 18, see FIG. 6. However, use of a plug 60 is not required.

Figure 6:
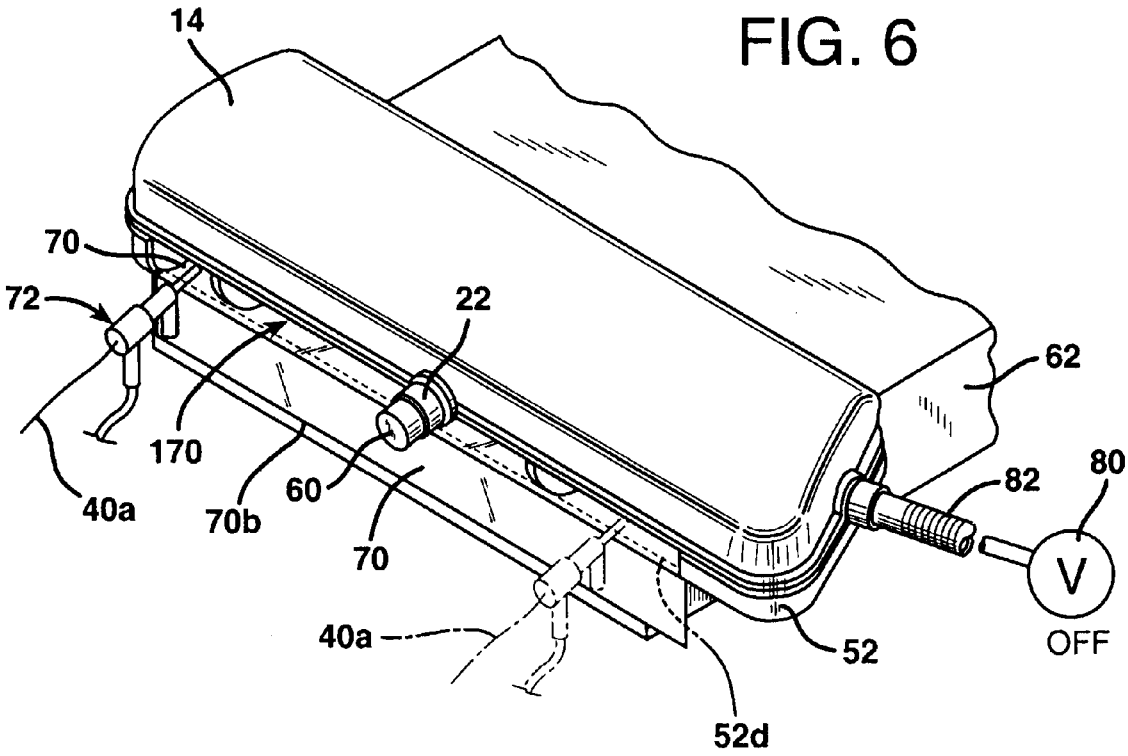
FIG. 6 is a view illustrating a fibrous filling operation after a first muffler shell outer part is positioned over the tool.

To fill the temporary inner cavity 170, a nozzle 72 of a conventional texturizing device 74 is positioned adjacent to or extended through the slot 52*d* in the tool 52, see FIG. 6. Such a device 74 is disclosed in U.S. Pat. Nos. 4,569,471 and 5,976,453, the disclosures of which are incorporated herein by reference. The fibrous material 40 may be formed from one or more continuous glass filament strands 40*a*, wherein each strand comprises a plurality of filaments. The filaments may be formed from E-glass or S-glass, or other glass compositions. For example, the continuous strand material 40*a* may comprise an E-glass roving sold by Owens Corning under the trademark ADVANTEX® or an S-glass roving sold by Owens Coming under the trademark Zen Tron®. It is also contemplated that ceramic fibrous material or other mineral fibrous material may be used instead of glass fibrous material. Pressurized air injected into the texturizing device 74 separates and entangles the filaments of the strand material 40*a* so that the strand material emerges from the nozzle 72 as a continuous length of "fluffed-up" or fibrous material 40. Once the fibrous material 40 fills the temporary inner cavity 170, it defines a wool-type product 40*b* in that cavity 170. It is noted that two or more smaller spaced-apart openings may be provided in the tool 52 instead of the single slot 52*d* shown in FIG. 2A for receiving the nozzle 72 of the texturizing device 74. It is also noted that all three compartments 30*a*–30*c*, which are the spaces defined between the partitions 24 and 26, see FIG. 8, may be filled with fibrous material 40. Alternatively, only one or two compartments may be filled with fibrous material while the remaining compartment or compartments are left unfilled.

A sufficient quantity of fibrous material 40 (for example, 90–120 grams/liter) is provided in the temporary inner cavity 170 between the partitions 24 and 26 and outer walls 52*f* and 52*g* of the tool 52 so as to allow the resultant muffler 10 to adequately perform its acoustic energy attenuation function.

As noted above, a first edge 70*a* of the sheet 70 is positioned a spaced distance from the back edge 52*c* of the tool 52. Hence, air is drawn through openings 52*a* in the tool 52 so as to create a partial vacuum in the temporary inner cavity 170. This vacuum causes the fibrous material 40 to be drawn inwardly into and compacted in the temporary inner cavity 170 during the filling operation. In the second embodiment, the perforations in the sheet define pathways through which air may pass so that a partial vacuum is created within the inner cavity 170.

Figure 7:
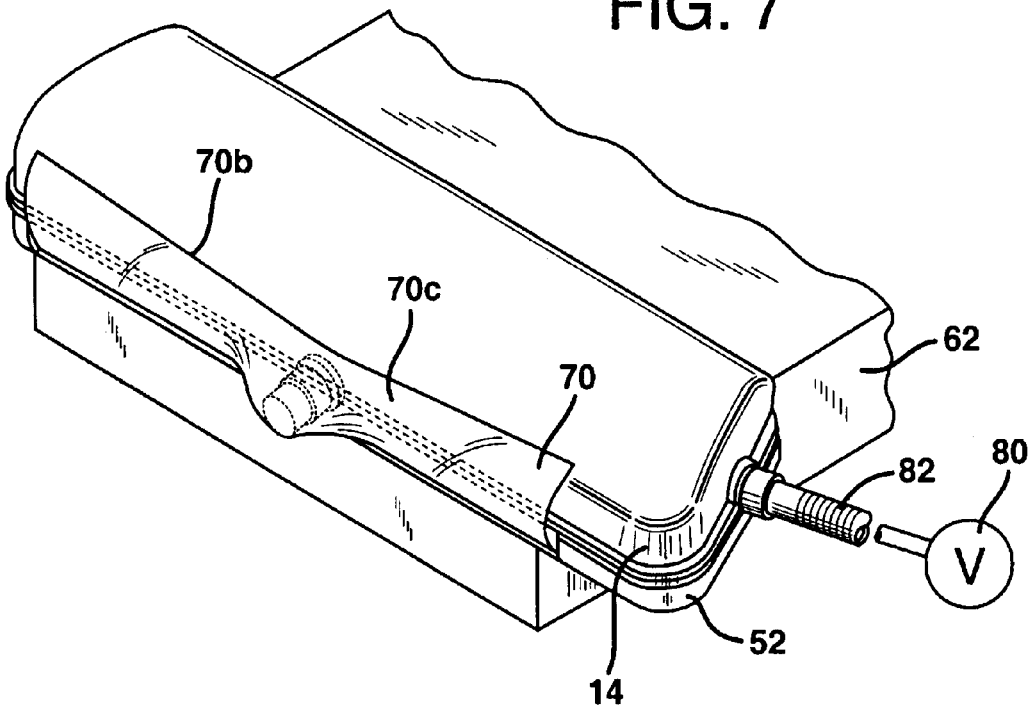
FIG. 7 is a view illustrating a portion of the sheet folded up over a portion of the first muffler shell outer part.

Once the temporary inner cavity 170 has been filled with fibrous material 40, the vacuum source 66 is deactivated. After the vacuum source 66 is deactivated, a partial vacuum is applied to the exit portion 20*a* of the perforated pipe 20. The partial vacuum is generated by a second vacuum source 80, which communicates with the perforated pipe exit portion 20*a* via a hose 82, see FIG. 7. During activation of the second vacuum source 80, the plug 60 remains positioned in the inlet pipe 22. The partial vacuum applied to the pipe exit portion 20*a* causes the fibrous material 40 and the sheet 70 to be drawn inwardly toward the internal structure 18. To increase the partial vacuum within the temporary inner cavity 170, a front portion 70*c* of the sheet 70 extending beyond the tool slot 52d may be moved upwardly so that it drapes over the first muffler shell outer part 14. By doing so, the slot 52*d* is essentially closed off, thereby reducing the amount of air drawn into the temporary cavity 170 through the slot 52*d*. It is also contemplated that instead of providing a second vacuum source, the hose 82 may be coupled by conventional structure to the first vacuum source 66.

Figure 8:
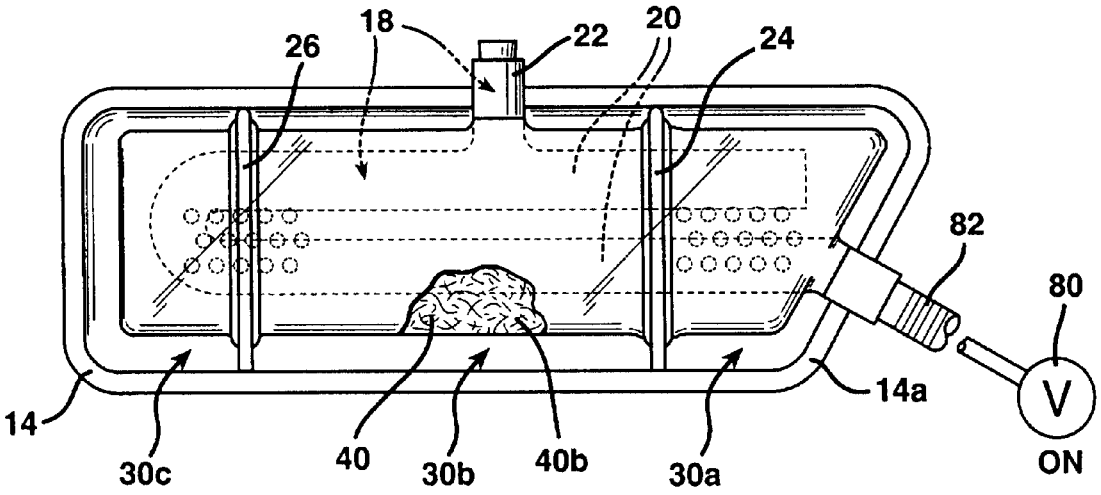
FIG. 8 is a view illustrating the first muffler shell outer part, the internal structure, the sheet and the fibrous material after being removed from the tool.

In the next step, the first muffler shell outer part 14, the internal structure 18, the sheet 70 and fibrous material 40 are removed from the tool 52, see FIG. 8. If a portion of the sheet 70 and/or fibrous material 40 extends beyond the outer edge 14*a* of the outer part 14, the sheet portion and/or fibrous material are repositioned so that they reside well within the edge 14*a* of the first outer part 14.

Figure 9:
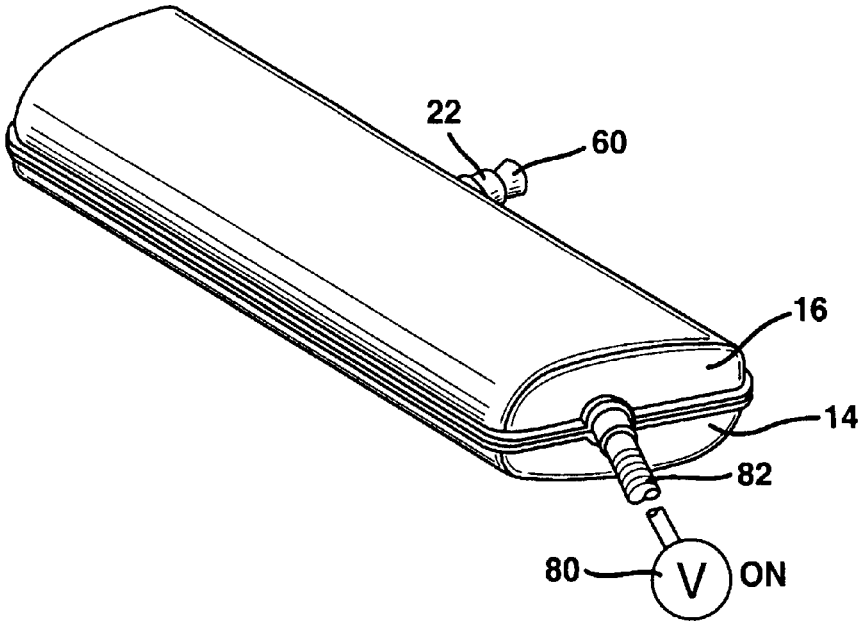
FIG. 9 is a view illustrating the second muffler shell outer part positioned over the first muffler shell outer part.
Figure 10:
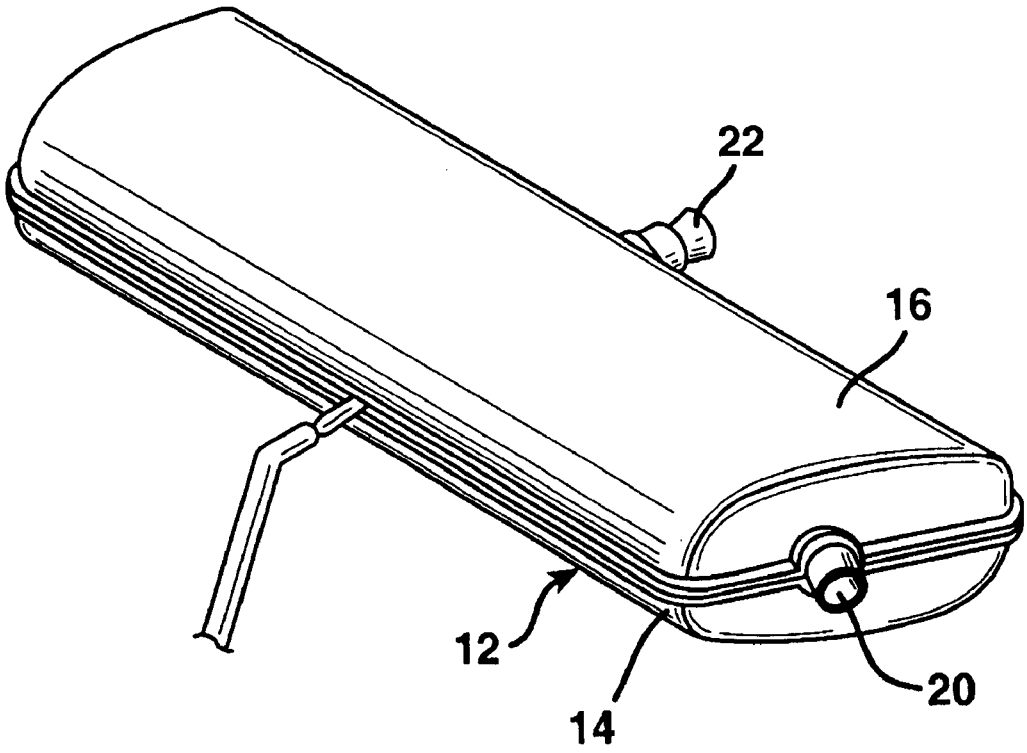
FIG. 10 is a view illustrating a welding operation for effecting the joining of the first and second muffler shell outer parts.

The second muffler shell outer part 16 is then placed onto the first muffler shell part 14, see FIG. 9, and joined to the first part 14 via a conventional welding operation, see FIG. 10. Alternatively, the two muffler shell parts 14 and 16 may be coupled together via a conventional flange crimping operation.

The vacuum source 80 may be deactivated and the plug 60 removed from the inlet pipe 22 prior to the welding operation.

In the illustrated embodiment, the tool 52 is generally located in a horizontal plane with its surface 52*b* facing upwardly. However, it is contemplated that the tool 52 may be positioned in a vertical plane or may be positioned horizontally with its surface 52*b* facing downwardly.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A process for filling a muffler shell with fibrous material comprising the steps of:

providing a muffler shell comprising first and second muffler shell outer parts which define an internal cavity when coupled together and an internal structure adapted to extend at least part way through the shell internal cavity and having one or more openings communicating with the shell internal cavity;

providing a perforated tool having opposing first and second surfaces;

providing a vacuum apparatus which is adapted to receive said perforated tool and apply a partial vacuum to said first surface of said tool;

placing a sheet adjacent said second surface of said perforated tool;

applying a partial vacuum to said first surface of said tool via said vacuum apparatus so as to draw said sheet against said tool second surface;

placing said internal structure adjacent said tool;

placing said first muffler shell outer part adjacent said tool such that said tool and said first part define a temporary inner cavity;

feeding fibrous material into said temporary inner cavity;

deactivating said vacuum apparatus;

drawing a partial vacuum through said internal structure so as to draw said fibrous material and said sheet toward said internal structure;

separating said first muffler shell outer part, said internal structure, said fibrous material and said sheet from said tool; and coupling said second muffler shell part to said first muffler shell part.

2. A process as set forth in claim 1, wherein said feeding step comprises the steps of:

providing a texturizing device having a nozzle;

feeding continuous strand material and pressurized air into said texturizing device such that a wool-type product emerges from said nozzle; and positioning said nozzle adjacent to or in said temporary internal cavity such that said wool-type product is fed into said temporary internal cavity.

3. A process as set forth in claim 1, wherein said vacuum apparatus comprises a structure with an inner cavity that communicates with a first vacuum source, said structure further including an edge portion defining an opening to said inner cavity and being adapted to receive said tool.

4. A process as set forth in claim 3, wherein said step of drawing a partial vacuum through said internal structure comprises the step of connecting said first vacuum source to said internal structure.

5. A process as set forth in claim 1, wherein said perforated tool has a plurality of openings and said step of placing a sheet adjacent said second surface of said perforated tool comprises the step of placing said sheet over said second tool surface such that said sheet covers at least a portion of said openings in said tool.

6. A process as set forth in claim 5, wherein said sheet covers only a first portion of said openings in said tool such that a second portion of said openings is left uncovered.

7. A process as set forth in claim 5, wherein said step of placing said internal structure adjacent said tool comprises the step of placing said internal structure in said tool over said sheet.

8. A process as set forth in claim 1, wherein said vacuum apparatus is deactivated after said fibrous material feeding step.

9. A process as set forth in claim 1, wherein said step of coupling said second muffler shell part to said first muffler shell part comprises the steps of:

placing said second muffler shell part adjacent said first muffler shell part such that said first and second muffler shell parts define an internal cavity containing said internal structure, said fibrous material and said sheet;

joining said first and second muffler shell parts to one another.

10. A process as set forth in claim 9, further comprising the step of discontinuing the step of drawing a partial vacuum through said internal structure after said step of placing said second muffler shell part adjacent said first muffler shell part.

11. A process as set forth in claim 1, wherein said step of drawing a partial vacuum through said internal structure comprises the step of coupling a second vacuum source to said internal structure.

12. A process as set forth in claim 1, wherein said internal structure comprises at least one perforated element.

13. A process as set forth in claim 1, wherein said internal structure comprises at least one partition defining at least two internal compartments within said muffler shell internal cavity, at least one of said internal compartments not including fibrous material.

14. A muffler filled with fibrous material and a sheet in accordance with the process set out in claim 1.

15. A muffler comprising:

a muffler shell comprising first and second muffler shell outer parts which define an internal cavity, said second muffler shell outer part including a first external surface and a second internal surface;

an internal structure adapted to extend at least part way through the shell internal cavity and having one or more openings communicating with the shell internal cavity;

fibrous material filled in said internal cavity; and a sheet extending only between said second internal surface of said second muffler shell part and said fibrous material.

16. A muffler as set forth in claim 15, wherein said internal structure comprises at least one perforated element.

17. A muffler as set forth in claim 15, wherein said fibrous material comprises a mineral fiber wool-type product.

18. A muffler as set forth in claim 15, wherein said internal structure comprises at least one partition defining at least two internal compartments within said muffler shell internal cavity, at least one of said internal compartments not containing fibrous material.

19. A vacuum-filling device adapted for use during a muffler shell filling operation, said muffler shell comprising first and second muffler shell outer parts which define an internal cavity when coupled together and an internal structure adapted to be positioned within the internal cavity, said device comprising:

a perforated tool having first and second surfaces; and a vacuum apparatus adapted to receive said perforated tool and apply a partial vacuum to said first surface of said tool.

20. A device as set forth in claim 19, wherein said vacuum apparatus comprises a structure with an inner cavity that communicates with a first vacuum source, said structure further including an edge portion defining an opening to said inner cavity and being adapted to receive said tool.

21. A device as set forth in claim 19, wherein said tool has generally the same shape as said second muffler shell outer part.

22. A device as set forth in claim 19, wherein said tool has at least one opening for receiving a nozzle of a texturizing device.

* * * * *